US010655366B2

(12) United States Patent
Cumbo

(10) Patent No.: US 10,655,366 B2
(45) Date of Patent: May 19, 2020

(54) LATCH FOR A DOOR OF A MOTOR VEHICLE

(71) Applicant: Magna Closures Inc., Newmarket (CA)

(72) Inventor: Francesco Cumbo, Pisa (IT)

(73) Assignee: MAGNA CLOSURES INC., Newmarket, Ontario (CA)

( * ) Notice: Subject to any disclaimer, the term of this patent is extended or adjusted under 35 U.S.C. 154(b) by 862 days.

(21) Appl. No.: 14/627,023

(22) Filed: Feb. 20, 2015

(65) Prior Publication Data

US 2015/0240536 A1 Aug. 27, 2015

(30) Foreign Application Priority Data

Feb. 24, 2014 (IT) ..... TO2014A0152

(51) Int. Cl.
*E05B 77/06* (2014.01)
*E05B 85/20* (2014.01)
*E05B 15/04* (2006.01)

(52) U.S. Cl.
CPC ..... *E05B 77/06* (2013.01); *E05B 85/20* (2013.01); *E05B 2015/041* (2013.01); *Y10T 292/108* (2015.04)

(58) Field of Classification Search
CPC ..... E05B 77/02; E05B 77/04; E05B 77/06; E05B 77/245; E05B 85/20; E05B 2015/041; Y10T 292/108; Y10T 292/1078; Y10S 292/22; Y10S 292/23
USPC ..... 292/200, DIG. 22, DIG. 23, 198
See application file for complete search history.

(56) References Cited

U.S. PATENT DOCUMENTS 3,799,596 A * 3/1974 Nozomu ..... E05B 77/06 180/286
5,865,481 A * 2/1999 Buschmann ..... E05B 77/06 292/169.11
6,328,353 B1 * 12/2001 Barczynski ..... E05B 77/26 292/216
6,648,382 B1 * 11/2003 Monig ..... E05B 77/06 292/336.3

(Continued)

FOREIGN PATENT DOCUMENTS

DE 19738492 A1 3/1998
DE 202008007673 U1 11/2009

(Continued)

OTHER PUBLICATIONS

Machine translation of DE 102011115009, pp. 1-6 (Year: 2018).*
International Search Report dated Nov. 11, 2014.
Written Report dated Nov. 11, 2014.

*Primary Examiner* — Christine M Mills
(74) *Attorney, Agent, or Firm* — Dickinson Wright PLLC

(57) ABSTRACT

A door latch for a motor vehicle includes a supporting body, a closing assembly cooperating with a latch striker, an opening mechanism having an opening lever rotatable about a first axis, and an inertia lever hinged to the supporting body about a second axis and being free to rotate about the second axis between a release position in which the inertia lever is decoupled from opening mechanism, and a first blocking position and a second blocking position in which the inertia lever engages the opening lever and prevents the opening mechanism from moving the closing assembly from a closing configuration to an opening configuration.

23 Claims, 5 Drawing Sheets

(56) References Cited

U.S. PATENT DOCUMENTS 6,971,688 B2 * 12/2005 Drysdale ..... E05B 77/06 292/216
7,481,468 B2 * 1/2009 Merideth ..... E05B 77/06 292/137
7,607,702 B2 * 10/2009 Pereverzev ..... E05B 77/06 292/201
7,686,355 B2 * 3/2010 Jankowski ..... E05B 77/06 292/216
8,056,944 B2 * 11/2011 Jankowski ..... E05B 77/06 292/201
8,322,077 B2 * 12/2012 Papanikolaou ..... E05B 77/06 292/336.3
2006/0261602 A1 * 11/2006 Jankowski ..... E05B 377/12 292/216
2006/0261603 A1 11/2006 Cetnar et al.
2007/0085349 A1 * 4/2007 Merideth ..... E05B 77/06 292/183
2008/0111381 A1 5/2008 Merideth et al.
2010/0237633 A1 * 9/2010 Jankowski ..... E05B 77/06 292/216
2011/0285150 A1 * 11/2011 Angelo ..... E05B 77/06 292/336.3
2013/0313036 A1 11/2013 Kovie
2014/0375069 A1 * 12/2014 Niegeloh ..... E05B 85/16 292/336.3
2016/0340941 A1 * 11/2016 Taurasi ..... E05B 83/24
2016/0362917 A1 * 12/2016 Cumbo ..... E05C 19/022
2017/0096843 A1 * 4/2017 Seo ..... B60J 5/0493

FOREIGN PATENT DOCUMENTS

DE 202008012949 U1 4/2010
DE 102011115009 A1 4/2012
DE 102011015675 A1 * 10/2012 ..... E05B 77/04
DE 102011015675 A1 10/2012
EP 1371799 A2 12/2003
EP 1518983 A2 * 3/2005 ..... E05B 77/06
FR 2970680 A1 * 7/2012 ..... E05B 77/04

* cited by examiner

LATCH FOR A DOOR OF A MOTOR VEHICLE

CROSS-REFERENCE TO RELATED APPLICATIONS

This application claims the benefit and priority of Italian Patent Application No. TO2014A000152 filed Feb. 24, 2014. The entire disclosure of the above application is incorporated herein by reference.

FIELD

The present disclosure relates to a latch for a closure member of a motor vehicle and, more particularly, to an inertia latch for a door of the motor vehicle.

BACKGROUND

This section provides background information related to the present disclosure which is not necessarily prior art.

In the following description and accompanying Claims, the term "door" is used broadly speaking to indicate any closure member movable between an open position and a closed position respectively for opening and closing an access opening to an Inner compartment of a vehicle, and therefore also includes boot and bonnet lids and rear hatches, in addition to the side doors of vehicles referred to in the description purely by way of example.

As is known, the doors of a motor vehicle normally comprise a frame-like top portion defining a window frame closed by a movable window when it is raised, and a box-like bottom portion comprising an outer panel and an inner panel joined at one end by an end edge and defining in between a cavity for normally housing the window when it is lowered, and various component parts fixed to the panels, such as a latch and a window regulating device.

A conventional latch typically includes a supporting body fixed to the vehicle door, a striker fixed to a frame of the vehicle door, a closure assembly carried by the supporting body and adapted to releasably engage the striker, and a release mechanism which is operatively connected to an outer handle of the door and can be selectively activated to release the closure assembly from the striker. More in detail, the closure assembly includes a ratchet which defines an open cylindrical seat, and a pawl. The ratchet is elastically loaded toward an opening position in which the ratchet enables engagement and disengagement between the striker and the seat of the ratchet. Furthermore, the ratchet is rotatably movable between the opening position and a closing position in which the ratchet holds the striker and prevents the disengagement of the striker from the closure assembly. The pawl is elastically loaded toward the ratchet for keeping the ratchet in the closing position. However, the pawl may be moved away from the ratchet by the release mechanism so as to allow the ratchet to elastically return to the opening position.

One conventional latch is known from EP-A-1371799, in which the release mechanism includes an extension lever which is operatively connected to the outer handle of the door, and a release lever which is hinged to the extension lever and can move from a latched position into an unlatched position when the outer handle of the door is flexed. When the ratchet is in the closing position, the release lever is in the latched position and is disengaged from the pawl. When the outer handle is flexed and the release lever moves from the latched position to the unlatched position, an end portion of the release lever moves the pawl away from the ratchet so as to allow the ratchet to return in the opening position. The release mechanism also includes an Inertia actuated lever which is operatively coupled to the release lever for securing the release lever in the latched position. In greater detail, the Inertia lever is hinged to a frame of the latch and comprises a detent tab for selectively engaging the release lever in the latched position. In a normal situation, the inertia lever is arranged in a release position, in which the detent tab is offset from the release lever in order to allow the release lever to move from the latched position to the unlatched position in response to activation of the outside handle. However, in case of collision, the inertia lever moves from the release position to a blocking position in which the detent tab blocks the release lever and prevents it from moving from the latched position into the unlatched position.

Improvements and alternatives to such inertia type latches are desirable.

SUMMARY

This section provides a general summary of the disclosure and is not intended to be considered as a comprehensive disclosure of its full scope or all of its objects and features.

It is therefore an object of the present invention to provide an Inertia latch for a motor vehicle including such improvements or alternatives.

This object is achieved for example by a latch for a door of a motor vehicle, as claimed in claim 1. In particular, a latch for a door of motor vehicle constructed according to the present invention comprises: a supporting body; a closing assembly adapted to cooperate with a latch striker and which can assume a closing configuration in which it engages the latch striker and keeps it in a fixed position and an opening configuration in which it is disengaged from the latch striker, an opening mechanism having an opening lever rotatable about a first axis between a latched position and an unlatched position; and an inertia lever hinged to the supporting body and free to rotate about a second axis, under certain acceleration conditions, between a release position whereat the Inertia lever is decoupled from the opening mechanism and a first blocking position and a second blocking position whereat the inertia lever holds the opening lever in its latched position to prevent the opening mechanism from moving the closing assembly from its closing configuration to its opening configuration.

In accordance with the latch constructed as above, one of the opening lever and the inertia lever includes a main portion, a first tooth and a second tooth protruding from the main portion, and a slot interposed between the first tooth and the second tooth. In addition, the other one of the opening lever and the inertia lever includes a main plate and a pin protruding from the main plate. The slot houses the pin when the inertia lever is in its release position to permit movement of the opening lever between its latched and unlatched positions. In contrast, the pin is arranged to abut the first tooth or the second tooth when the inertia lever is set respectively in its first blocking position or its second blocking position. The opening mechanism being selectively movable between a latched configuration in which it maintains the closing assembly in its closing configuration and an unlatched configuration in which it causes the closing assembly to move from its closing configuration into its opening configuration. The inertia lever is rotatable in a first direction from its release position to its first blocking position about the second axis, and the inertia lever is also rotatable in a second direction, opposite to the first direction, from its release position to its second blocking position about the second axis.

Further areas of applicability will become apparent from the description provided herein. The description and specific examples in this summary are intended for purposes of illustration only and are not intended to limit the scope of the present disclosure.

DRAWINGS

A preferred, non-limiting embodiment of the present invention will be described by way of example with reference to the accompanying drawings, in which.

DETAILED DESCRIPTION

One or more example embodiments will now be described more fully with reference to the accompany drawings. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 3:
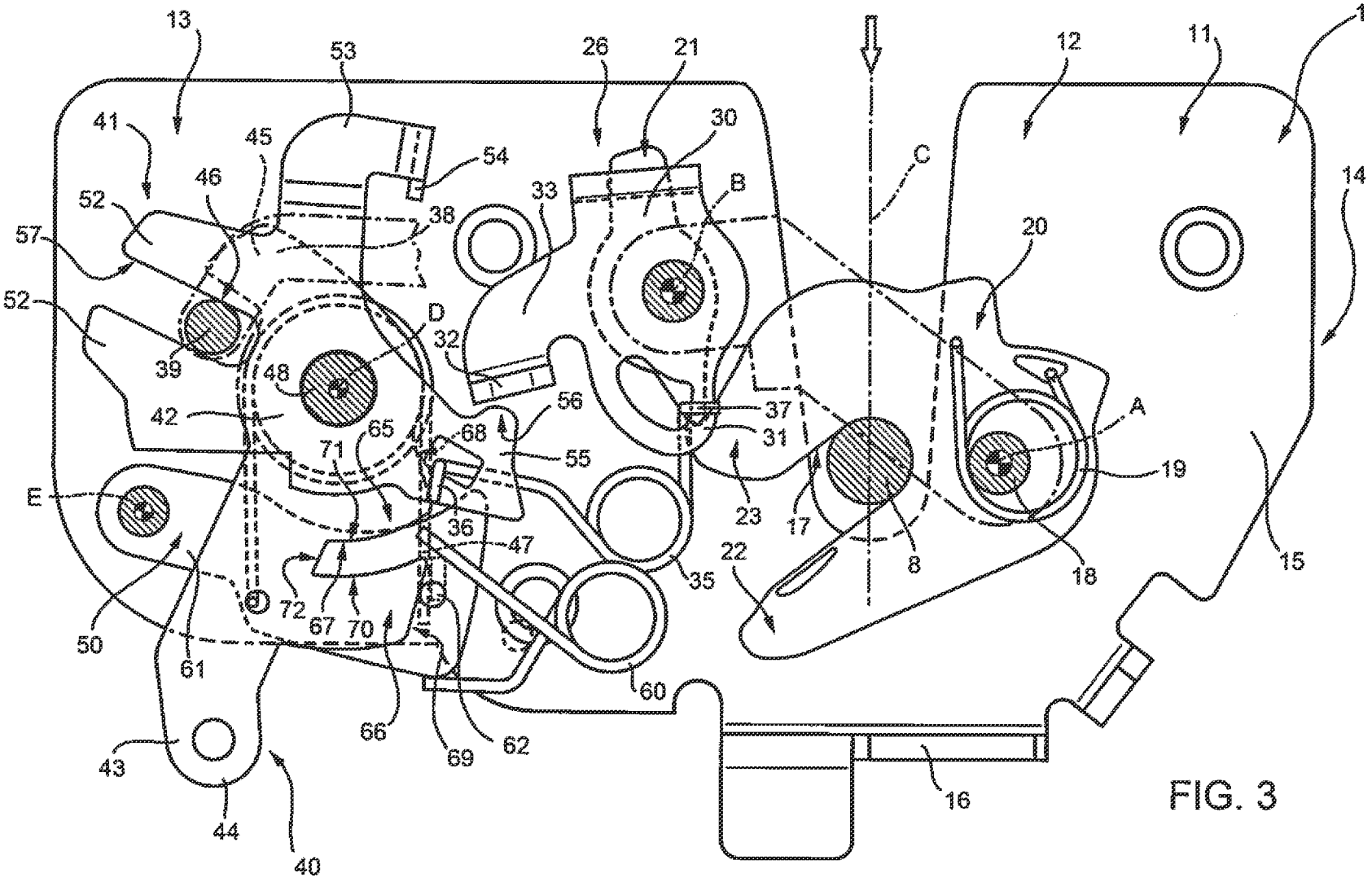
FIG. 3 is a top view of the latch of FIGS. 1 and 2, with the inertia lever arranged in a second blocking position, with components removed for clarity.
Figure 4:
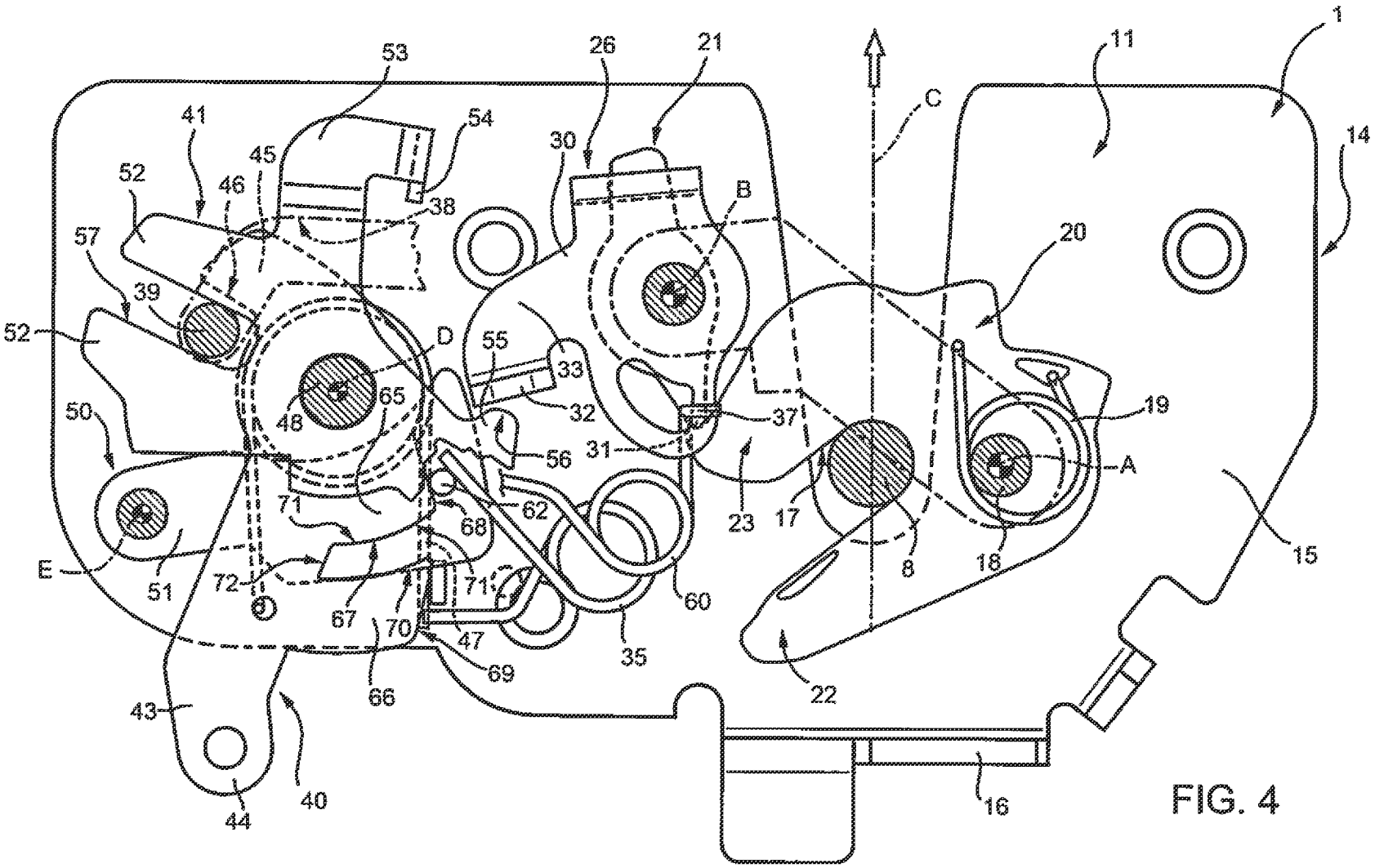
FIG. 4 is a top view of the latch of FIGS. 1 and 2, with the inertia lever arranged in a first blocking position, with components removed for clarity.
Figure 5:
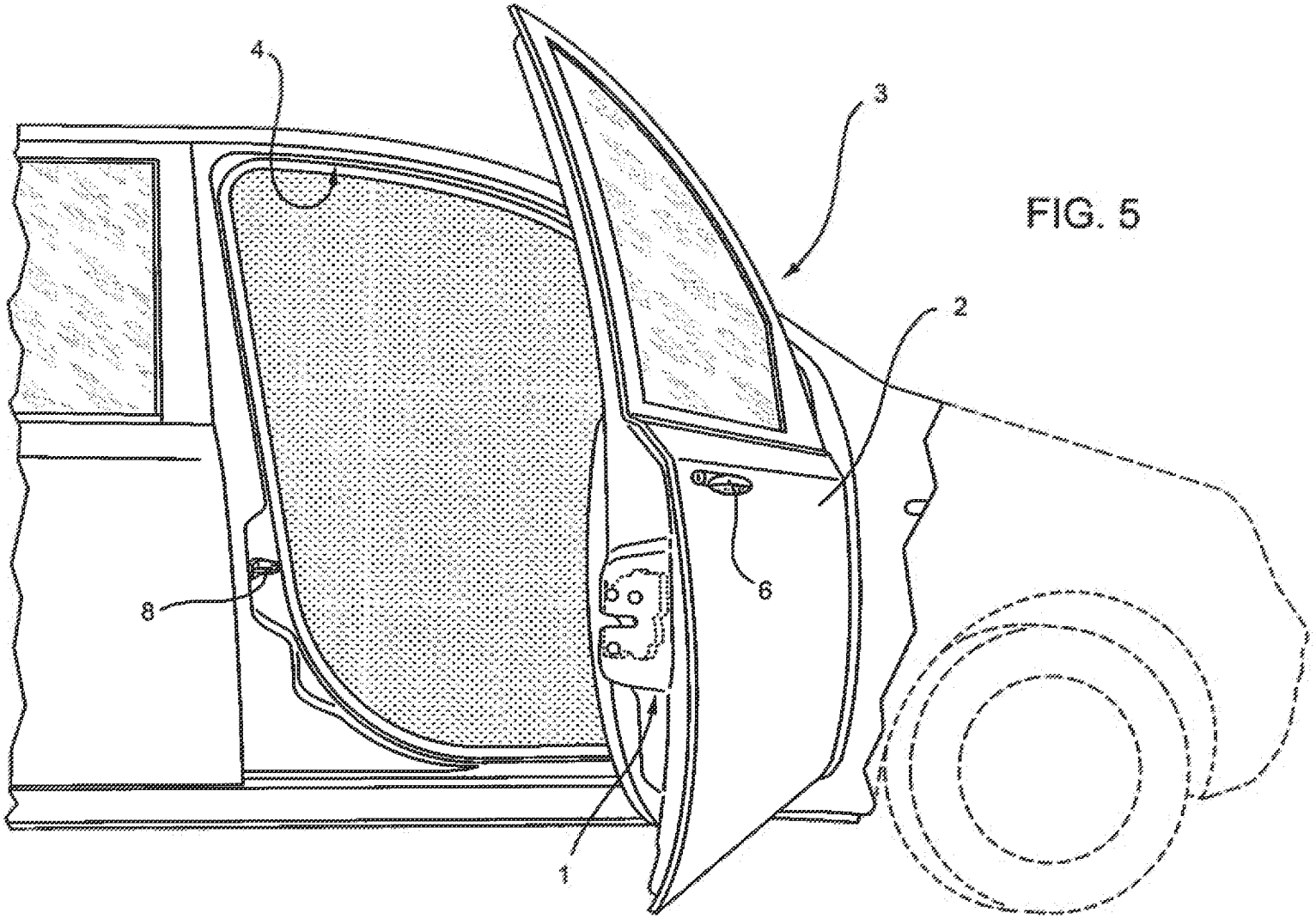
FIG. 5 is a schematic view if a door of a motor-vehicle with the latch of FIGS. 1 to 4.

Referring to FIGS. 1 to 5, reference numeral 1 indicates a latch for a door 2 of a motor vehicle 3 (only partially shown in FIG. 5). Door 2 is movable between an open position and a closed position respectively for opening and closing an access opening 4 to an inner compartment of motor vehicle 3. Door 2 comprises a frame-like top portion defining a window frame closed by a movable window when the window is raised, and a box-like bottom portion comprising an outer panel and an inner panel joined at one end by an end edge and defining a cavity normally housing the window when the window is lowered, and various component parts fixed to the panels, such as a latch 1 and a window regulating device.

In greater detail, latch 1 is shown in FIGS. 1 through 4 to comprise: a supporting body 11 fixed in known manner to door 2; a closure assembly 12 carried by supporting body 11 and adapted to releasable engage a striker 8 integrally mounted to a fixed part of motor vehicle 3; and an opening assembly 13 which may operated by a user to disengage striker 8 from closure assembly 12. Furthermore, supporting body 11 substantially comprises a hollow shell 14 (only partially shown in FIGS. 1 to 4), which houses the closure assembly 12. Shell 14 is shown only with reference to a plate 15 and a wall 16 projecting from plate 15 and substantially orthogonal to wall 16.

Closure assembly 12 is shown to include a ratchet 20 hinged to plate 15 about a first axis "A" orthogonal to the plane on which plate 15 lies; a pawl 21 hinged to plate 15 about a second axis "B" that is also orthogonal to the plane on which plate 15 lies and parallel to and staggered from axis A, and a pawl lever 26 which is coaxial with pawl 21 and angularly movable with pawl 21 about axis B.

More precisely, ratchet 20 comprises a seat 17, U-shaped in the embodiment shown, bounded by a pair of teeth 22, 23 and configured for receiving striker 8. Furthermore, ratchet 20 is normally loaded by a spring 19 toward an opening position (not shown) in which seat 17 faces a direction "C" along which striker 8 may enter or exit seat 17. Spring 19 is interposed between plate 15 and ratchet 20 and is, in the embodiment shown, a spiral spring wound about axis A. In particular, spring 19 is wound about a pin 18 which extends about axis A. In the embodiment shown, direction C is orthogonal to axes A, B.

Under the action of striker 8 and, as a result of the slamming of door 2, ratchet 20 rotates when moving from the opening position to a closing position (FIG. 1) in a first rotary direction (anti-clockwise with reference to FIGS. 1 to 4), about axis A.

Figure 1:
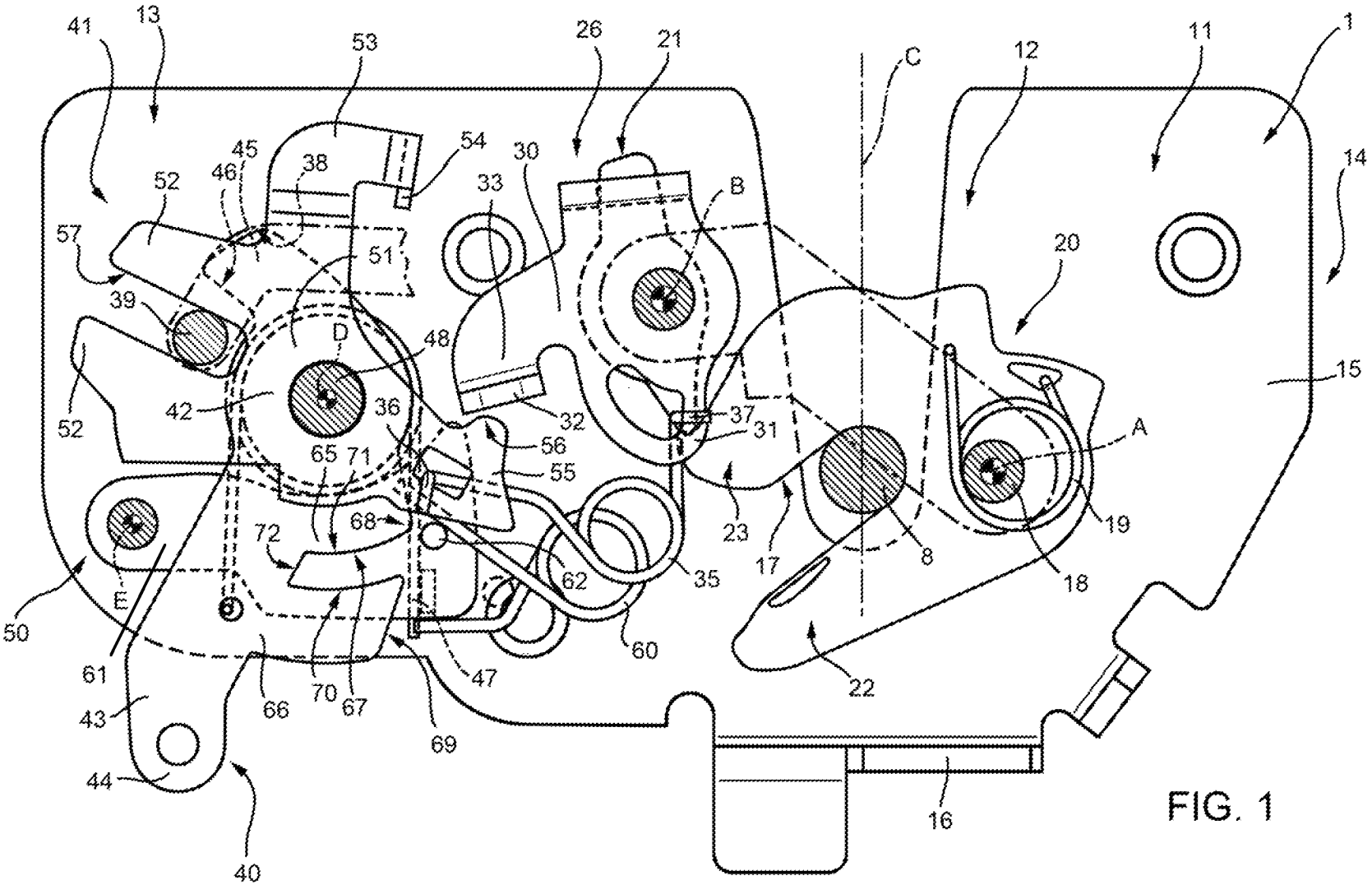
FIG. 1 is a top view of a latch for a motor vehicle constructed according to the present disclosure and showing a release mechanism in a first position and an inertia lever arranged in a release position, with components removed for clarity.

Pawl 21 is shown to include a plate 30 hinged about axis B to plate 15 and which lies on a plane orthogonal to axis B, and a tooth 31 defined by plate 30. Furthermore, pawl 21 is elastically loaded by a not-shown spring so as to be biased toward a position in which tooth 31 contacts tooth 23 of ratchet 20 and blocks movement of ratchet 20 so as to retain it in the closing position (FIG. 1).

Pawl lever 26 is shown to include an arm 33 from which an appendix 32 orthogonally protrudes on the opposite side of pawl tooth 31. Appendix 32 is adapted to receive an action by opening mechanism 13 so as to move pawl 21 in a second rotary direction (clockwise in FIGS. 1 to 4) about axis B and to render ratchet 20 free to rotate about axis A in the second direction (clockwise in FIGS. 1 to 4) toward the opening position.

Figure 2:
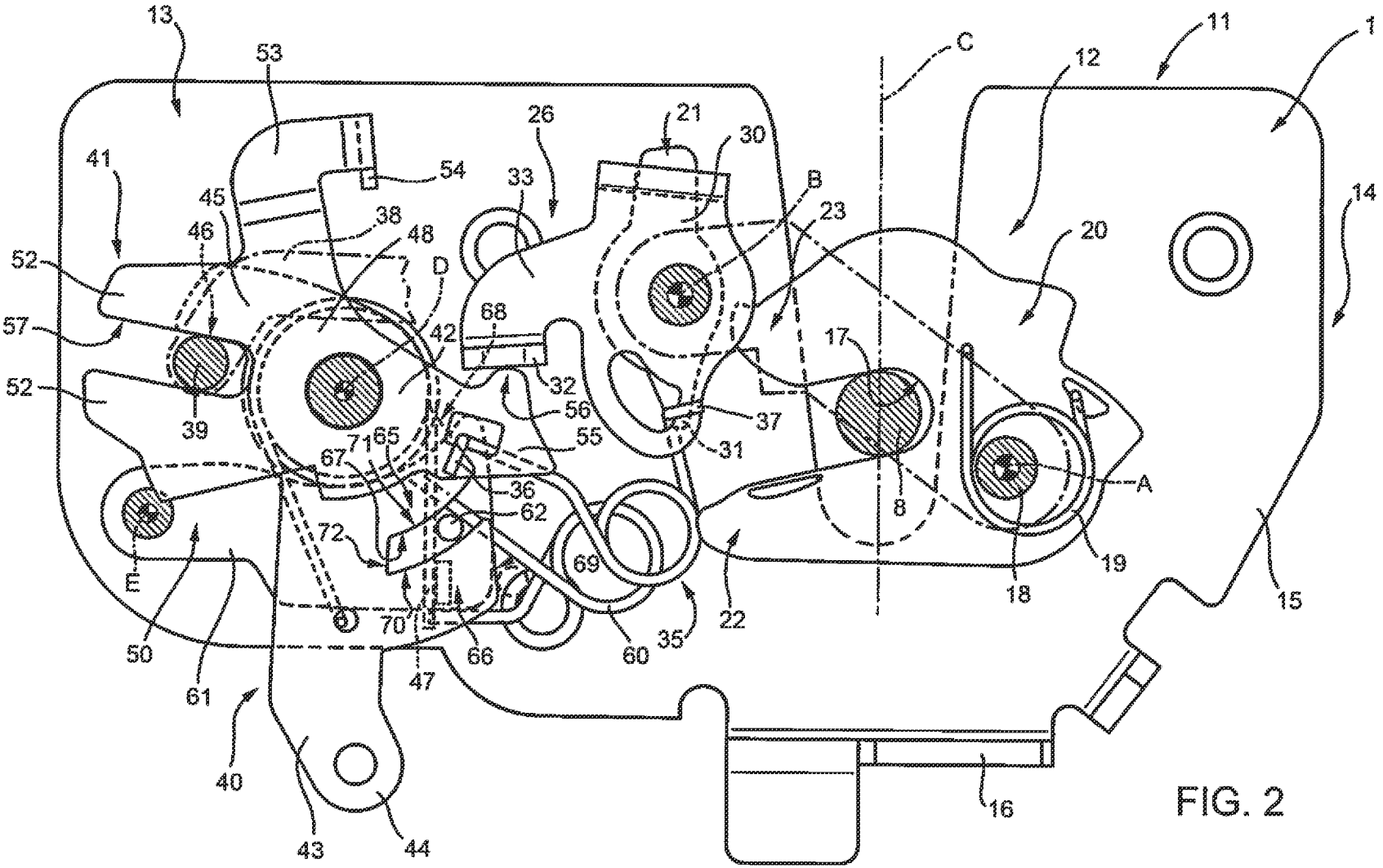
FIG. 2 is a top view of the latch of FIG. 1, showing the release mechanism in a second position and the inertia lever arranged in the release position, with components removed for clarity.

Opening mechanism 13 is shown to include a first opening lever 40 hinged about a third axis "D" and operatively connected in a not-shown way to an outer handle 6 of door 2, and a second opening lever 41 that is also hinged about axis D and operatively connected in a not-shown way to an inner handle (not-shown) of door 2. In greater detail, lever 41 is movable between an unlatched position (FIG. 2) and a latched position (FIGS. 1, 3 and 4). With lever 41 in its unlatched position, it interacts with pawl lever 26 so as to rotate it about axis B in the clockwise direction, thus disengaging pawl 21 and ratchet 20 from one another and causing ratchet 20 to return in its opening position. With lever 41 in its latched position, it is disengaged from pawl lever 26 so that pawl lever 26 and pawl 21 can elastically keep pawl 21 and ratchet 20 in the closing position. In particular, when the inner door handle is flexed, lever 41 is moved from its latched position into its unlatched position. Furthermore, lever 41 is elastically biased toward its latched position.

Lever 40 is movable between a latched position (FIGS. 1, 3 and 4) in which it and lever 41 are disengaged from pawl lever 26 so as to keep pawl 21 and ratchet 20 in the closing position, and an unlatched position (FIG. 2) in which it interacts, directly or indirectly, with pawl lever 26 and/or pawl 21, so as to rotate pawl 21 about axis B in the second direction (clockwise in FIGS. 1 to 4), thus disengaging pawl 21 and ratchet 20 from one another and causing ratchet 20 to return in the opening position. In particular, when outer door handle 6 is flexed, lever 40 is moved from its latched position to its unlatched position. Furthermore, lever 40 is elastically biased toward its latched position.

In the embodiment shown, lever 41 is coupled to lever 40. In particular, movement of lever 40 from its latched position to its unlatched position, upon the action of outer handle 6, causes coordinated movement of lever 41 from its latched position to its unlatched position. As a result, pawl 21 disengages ratchet 20, which can thereafter move toward its opening position.

Alternatively, levers 40, 41 can be coupled to one another. In this case, the elastic return of level 40 from its unlatched position can cause concurrent movement of lever 41 from its unlatched position to its latched position.

In detail, lever 40 lies on a plane orthogonal to axis D and includes a main portion 42 hinged to supporting body 11 about axis D, an arm 43 which protrudes from main portion 42 and has an end 44 operatively connected to handle 6, and an arm 45 which protrudes from main portion 42 in a sloped way with respect to arm 43 and defines a tooth 46.

Latch 1 also includes a spring 47 which is interposed between supporting body 11 and lever 40 and is adapted to elastically bias lever 40 toward its latched position. In detail, spring 47 is wound about axis D on a pivot pin 48 protruding from main portion 42 and has its opposite ends connected to arm 43 of lever 40 and supporting body 11. In the embodiment shown, main portion 42 is cylindrical. Upon action of outer handle 6 on end 43, lever 40 rotates in the first rotary direction (anticlockwise in FIGS. 1 to 4).

Lever 41 lies on a plane orthogonal to axis D and is superimposed on lever 40. Lever 41 is shown to include a main portion 51 hinged to supporting body 11 about axis D on pivot pin 48 and lying orthogonally to axis D, a pair of teeth 52 defined by main portion 51 and defining therebetween a slot 57, an arm 53 defining an end appendix 54 operatively connected to the inner door handle, and an arm 55 which defines a tooth 56. Tooth 56 is spaced from appendix 32 of pawl lever 26, when levers 40, 41 are in their respective latched positions and pawl 21 is engaged with ratchet 20 in the closing position (FIG. 1). In contrast, tooth 56 contacts and thrusts appendix 32 of pawl lever 26 when levers 40, 41 are moved into their respective unlatched position, thus causing rotation of pawl 21 to release ratchet 20 for permitting movement of ratchet 20 into the opening position (FIG. 2).

Latch 1 also includes a spring 35 interposed between pawl lever 26 and lever 41. Still more precisely, spring 35 is wound about an axis parallel to axes A, B and D, and comprises opposite ends 36, 37. End 36 is fitted to arm 55 of lever 41 while end 37 is fitted to pawl lever 26.

Latch 1 also includes a groove 38 and a pin 39 which slides inside groove 38 and extends parallel to axes A, B, D. Pin 39 engages groove 38 and can be contacted by tooth 46 on arm 45 of lever 40, when the latter rotates in the first direction (anticlockwise with reference to FIGS. 1 and 4) upon the activation of handle 6 (see FIG. 2). Furthermore, pin 39 is interposed between teeth 52 of lever 41. As a result, the movement of pin 39 inside groove 38 causes rotation of lever 41 in the first direction (anticlockwise with reference to FIGS. 1 and 4).

Latch 1 further comprises an inertia lever 50 which is adapted to activate, in case of collision, due to the resulting acceleration to assist in maintaining the ratchet 20 in its closed position. In greater detail, inertia lever 50 is hinged to supporting body 11 about a fourth axis "E" and can oscillate about axis E, due to its mass and as a result of a collision of motor vehicle 3, in particular under an acceleration directed parallel to direction C. In the embodiment shown, inertia lever 50 is made of a material commercial known as ZAMAK, i.e. a family of alloys with a base metal of zinc and alloying elements of aluminum, magnesium and copper. Axis E is arranged on the opposite side of axes A, B with respect to axis D.

In particular, inertia lever 50 can oscillate, in a first direction (anticlockwise with reference to FIGS. 1 to 4) between a release position (FIG. 1) in which it is disengaged from lever 40, and a plurality of first blocking positions (FIG. 4) in which it blocks lever 40 from moving out of its latched position. Inertia lever 50 can also oscillate, in a second direction (clockwise with reference to FIGS. 1 to 4), opposite to the first direction, with respect to supporting body 11 between the release position (FIG. 1) and a plurality of second blocking positions (FIG. 3) in which it also functions to block lever 40 from moving out of its latched position. Latch 1 also comprises a spring 60 which pre-loads and normally locates inertia lever 50 in its release position.

Inertia lever 50 is shown to include a main plate having an arm segment 61 hinged about axis E to supporting body 11, and a pin 62 protruding from the main plate and arranged on the opposite side of arm segment 61 with respect to axis E. With reference to FIGS. 1 to 4, inertia lever 50 is arranged below lever 41 such that pin 62 protrudes upwardly from the main plate. Furthermore lever 40 is arranged above inertia lever 50, with reference to FIGS. 1 to 4. Spring 60 is interposed between supporting body 11 and an area of the main plate adjacent to pin 62.

Lever 40 further includes a first tooth 65 and a second tooth 66 both protruding from main portion 42, and a slot 67 which is interposed between teeth 65, 66. First and second teeth 65, 66 define respective first and second abutting surfaces 68, 69, which lie on a plane orthogonal to axis E. Slot 67 is bounded by an arcuate surface 70 adjacent to second abutting surface 69, an arcuate surface 71 adjacent to first abutting surface 68, and an end surface 72 interposed between arcuate surfaces 70, 71. The width dimension of slot 67 is selected to permit pin 62 to slide therein with clearance between surfaces 70, 71.

When inertia lever 50 is in its release position and lever 40 is in its latched position (FIG. 1), pin 62 is decoupled from lever 40. In other words, when set in its release position, inertia lever 50 is disengaged from, i.e. does not interfere with, the trajectory of lever 40 as it moves between its latched position and its unlatched position.

In this way, when outside handle 6 is flexed, lever 40 can rotate in the first direction (anticlockwise in FIGS. 1 to 4) about axis D from its latched position toward its unlatched position, thus causing the rotation of lever 41 in the same anticlockwise rotation about axis D from its latched position toward its unlatched position. As a result, tooth 56 of lever 41 contacts appendix 32 of pawl lever 26 and drives in rotation in the second direction (clockwise in FIGS. 1 to 4) pawl 21 and pawl lever 26 about axis B. As a result, pawl 21 disengages ratchet 20 which can, therefore, return to its opening position under the action of spring 19.

During movement of lever 40 from its latched position to its unlatched position, while inertia lever 50 is set in its release position, pin 62 is aligned along an arc of circumference having centre on axis D and slides inside slot 67, as best shown in FIG. 2.

In case of a vehicular collision, especially of lateral impact of motor vehicle 3, latch 1 is generally subjected to an acceleration directed along direction C in a first direction or sense (downward direction in FIG. 3) and in a second direction or sense (upward direction in FIG. 4).

Starting from a configuration of latch 1 in which levers 40, 41 are in their respective latched positions and inertia lever 50 is in its release position (FIG. 1), an acceleration of supporting body 11 in the first sense causes inertial rotation of inertia lever 50 in the second direction (clockwise in FIG. 3) to one of a plurality of second blocking positions in which pin 62 abuts against second abutting surface 69 formed on tooth 66. In this way, inertia lever 50 assists in preventing lever 40 from moving from its latched position to its unlatched position, under the acceleration in the first sense caused by the collision. A plurality of such second blocking positions are established by pin 62 abutting different portions of second abutting surface 69 based on the amount of inertial rotation of inertia lever 50 in the second direction caused by the collision.

In the very same way, an acceleration of supporting body 11 in the second sense causes inertial rotation of inertia lever 50 in the first direction (anticlockwise in FIG. 4) to one of a plurality of first blocking positions in which pin 62 abuts against first abutting surface 68 formed on first tooth 65. In this way, inertia lever 50 assists in preventing lever 40 from moving from its latched position to its unlatched position, under the acceleration in the second sense caused by the collision. Again, a plurality of the first blocking positions are established by pin 62 abutting different portions of first abutting surface 68 based on the amount of inertial rotation of inertia lever 50 in the first direction.

The operation of latch 1 is described in the following of the present description, starting from a configuration in which (FIG. 1) latch 1 locks door 2 to frame 4. In this configuration, ratchet 20 is in its closing position and pawl 21 is elastically loaded into the closing position of ratchet 20, in which tooth 31 of paw 21 contacts tooth 23 of ratchet 20. Furthermore, spring 47 loads lever 40 into its latched position. In the case where levers 40 and 41 are coupled, lever 41 of the opening mechanism 13 can also be elastically loaded by spring 47 into its latched position such that they do not engage pawl lever 26. Still more precisely, tooth 56 is angularly spaced from appendix 32 of pawl lever 26, when levers 40, 41 are in their respective latched positions. Finally, when inertia lever 50 is in its release position, pin 62 is positioned outside slot 67 and is spaced from first and second abutting surfaces 68, 69 of respective first and second teeth 65, 66. Accordingly, inertia lever 50 is disengaged from the trajectory of lever 40 upon its movement about axis D from its latched position to its unlatched position.

When handle 6 is flexed, lever 40 is rotated in the first direction (anticlockwise in FIGS. 1 to 4) about axis D. As lever 40 rotates about axis D in the first direction, slot 67 houses pin 62 with clearance relative to surfaces 70, 71. Accordingly, inertia lever 50 is disengaged from lever 40. As a result, as shown in FIG. 2, tooth 46 contacts pin 39 which, in turn, causes rotation of lever 41 in the first direction (anticlockwise in FIGS. 1 to 4) about axis D. As a result of such rotation of lever 41 in the first direction, tooth 56 contacts appendix 32 of pawl lever 26. Accordingly, pawl lever 26 rotates, against the action of the spring, about axis B in the second direction (clockwise in FIGS. 1 to 4) and disengages ratchet 20. Ratchet 20 can therefore elastically rotate in the second direction about axis A and under the action of spring 19 to reach its opening position (not-shown) in which seat 17 is aligned with direction C.

In case of a collision of motor vehicle 3, especially a lateral impact against door 2, supporting body 11 is subjected to an acceleration directed along direction C in the first sense (downward direction in FIG. 3) and in the second sense (upward direction in FIG. 4). Starting from the configuration shown in FIG. 1, an acceleration of supporting body 11 in the first sense (FIG. 3) causes inertial rotation of inertial lever 50 in the second direction (clockwise in FIGS. 1 to 4) from its release position into one of its second blocking positions. As a result of such inertial rotation of inertial lever 50, pin 62 abuts against second abutting surface 69 on second tooth 66. In this way, inertia lever 50 is operable in its second blocking position to block lever 40 in its latched position, and assists in avoiding that the acceleration due to the collision causes the release of pawl 21 and ratchet 20. Still more precisely, inertia lever 50 is interposed along the trajectory of lever 40 for inhibiting movement from its latched position into its unlatched position.

In the very same way, an acceleration of supporting body 11 in the second sense (FIG. 4) causes inertial rotation of inertia lever 50 in the first direction (anticlockwise in FIGS. 1 to 4) from its release position into one of its first blocking positions. As a result of such inertial rotation of lever 50, pin 62 abuts against first abutting surface 68 on first tooth 65. Again, in this case, inertia lever 50 blocks lever 40 in its latched position, and assists in avoiding that the acceleration due to the collision causes the release of pawl 21 and ratchet 20. Still more precisely, inertia lever 50 is, also in this case, interposed along the trajectory of lever 40 to inhibit movement thereof from its latched position to its unlatched position.

The advantages of latch 1 according to the present invention will be clear from the foregoing description.

In greater detail, inertia lever 50 is movable in a first direction between its release position and a plurality of first blocking positions (FIG. 4) and in a second direction, opposite to first direction, between its release position and a plurality of second blocking positions (FIG. 3). In this way, inertia lever 50 is capable of securing lever 40 and, therefore, the entire opening mechanism 13 in the respective latched configuration, both when the acceleration deriving from the collision is directed in the first sense (FIG. 3) and when the acceleration is directed in the second sense (FIG. 4). Furthermore, the securing of lever 40 and, therefore, of whole opening mechanism 13 in the respective latched configuration, is independent of the synchronization between inertia lever 50 and lever 40.

Pin 62 is detached (i.e. disengaged) from lever 40 when inertia lever 50 is in its release position and levers 40, 41 are in their respective latched positions (FIG. 1). Slot 67 houses with room pin 62, when inertia lever 50 is in its release position and levers 40, 41 move toward their respective unlatched positions (FIG. 2) via actuation of one of the door handles. In this way, inertia lever 50, when set in its release position, does not interfere with opening mechanism 13 when it is required to release ratchet 20 from pawl 21.

Pin 62 abuts against first and second abutting surfaces 68, 69 when lever 50 is respectively in its first blocking position and in Its second blocking position. In this way, inertia lever 50, when set in one of its first and second blocking positions, prevents lever 40 from moving from its latched position to its unlatched position.

Clearly, changes may be made to latch 1 as described and Illustrated herein without, however, departing from the scope defined in the accompanying claims. In particular, teeth 65, 66 and slot 67 could be carried by inertia lever 50 instead of by lever 40 and pin 62 could be carried by lever 40 instead of by inertia lever 50.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A latch for a door of a motor vehicle, comprising:

a supporting body;

a closing assembly adapted to cooperate with a latch striker and which can assume a closing configuration in which the closing assembly engages the latch striker and keeps the closing assembly in a fixed position, and an opening configuration in which the closing assembly is disengaged from the latch striker;

an opening mechanism having an opening lever lying in a plane orthogonal to a first axis and rotatable about said first axis, said opening mechanism being selectively movable between a latched configuration in which said opening mechanism leaves said closing assembly in said closing configuration and an unlatched configuration in which said opening mechanism causes said closing assembly to move from said closing configuration into said opening configuration; and an inertia lever mounted to and housed within said supporting body and being free to rotate about a second axis between a release position in which said inertia lever is decoupled from said opening mechanism and a plurality of first blocking positions and a plurality of second blocking positions in which said inertia lever prevents said opening mechanism from moving said closing assembly from said closing configuration to said opening configuration;

wherein one of said opening lever and said inertia lever includes, in the plane, a main portion, a first tooth and a second tooth protruding from said main portion to a respective first abutting surface and a second abutting surface, and a slot interposed between said first tooth and said second tooth and extending from said first abutting surface and said second abutting surface to an end surface, wherein the other one of said opening lever and said inertia lever includes a main plate and a pin protruding from said main plate, wherein said slot is configured to receive said pin when said inertia lever is in said release position, and wherein said pin abuts said first abutting surface of said first tooth or said second abutting surface of said second tooth when said inertia lever is rotated to one of said plurality of first blocking positions or rotated to one of said plurality of second blocking positions;

wherein said inertia lever is rotatable in a first direction from said release position to one of said plurality of first blocking positions about said second axis to rotate said pin into abutment with a portion of said first abutting surface of said first tooth based on the amount of inertial rotation of said inertia lever and prevent rotation of said opening lever about said first axis in response to an acceleration of said supporting body in a second direction opposite the first direction, and wherein said inertia lever is rotatable in a second direction, opposite to said first direction, from said release position to one of said plurality of second blocking positions about said second axis to rotate said pin into abutment with a portion of said second abutting surface of said second tooth based on the amount of inertial rotation of said inertia lever and prevent rotation of said opening lever about said first axis in response to an acceleration of said supporting body in the first direction.

2. The latch of claim 1 wherein said inertia lever includes said main plate and said pin, and wherein said opening lever includes said main portion, said first tooth and said second tooth protruding from said main portion and said slot formed between said first tooth and said second tooth.

3. The latch of claim 2 further comprising a spring for loading said inertia lever toward said release position, and wherein said spring is fixed to said inertia lever on an opposite side of said inertia lever with respect to said second axis.

4. The latch of claim 2 wherein said opening lever is operatively connected, either directly or indirectly, to said closing assembly, wherein said first abutting surface and said second abutting surface that are distinct and separate from one another, and wherein said first tooth is bounded by said first abutting surface and said second tooth is bounded by said second abutting surface.

5. The latch of claim 4 wherein said pin cooperates, in use, with said first abutting surface and said second abutting surface of said opening lever when said inertia lever is in said first blocking position and said second blocking position respectively and said opening mechanism is in said latched configuration so as to block movement of said opening lever.

6. The latch of claim 4 wherein said slot is formed in said opening lever so as to be interposed between said first abutting surface and said second abutting surface.

7. The latch of claim 2 wherein said opening lever is movable between a latched position and an unlatched position, and wherein said slot is movable relative to said pin and houses with room said pin when said inertia lever is in said inertia lever release position and said opening lever moves from said opening lever latched position into said opening lever unlatched position for causing said opening mechanism to move from said latched configuration into said unlatched configuration.

8. The latch of claim 7 wherein said inertia lever is operable in the plurality of first and the second blocking positions to block said opening lever in said opening lever latched position.

9. The latch of claim 7 wherein said slot allows said pin to slide with clearance between said first tooth and said second tooth so as not to interfere with the trajectory of said opening lever as it moves from said opening lever latched position into said opening lever unlatched position.

10. The latch of claim 1 wherein said closing assembly comprises:

a ratchet which can assume an opening position in which said ratchet enables engagement and disengagement between the latch striker and a seat portion of said ratchet, and a closing position in which said ratchet holds the latch striker within said seat portion; and a pawl movable between a decoupled position in which said pawl permits the movement of said ratchet from said closing position to said opening position, and a coupled position in which said pawl is coupled with said ratchet for holding said ratchet in said closing position and preventing disengagement of the latch striker from said seat portion.

11. The latch of claim 10 wherein said opening lever is connectable to an outer handle of the motor vehicle, and wherein said opening mechanism includes a second opening lever operatively connected to said opening lever and configured to interact with said closing assembly when said opening mechanism moves, in use, from said latched configuration to said unlatched configuration so as to displace said closing assembly into said opening configuration.

12. The latch of claim 1 wherein said inertia lever, when in the release position, does not interfere with movement of said opening mechanism between the latched configuration and the unlatched configuration.

13. The latch of claim 1 wherein said inertia lever, during a collision resulting in acceleration of said inertia lever in one of a first sense and a second sense, is allowed to rotate from the release position in the first direction in the case where the acceleration is in the first sense, and is allowed to rotate from the release position in the second direction in the case where the acceleration is in the second sense.

14. A motor vehicle comprising:

a door with an outer handle; and a latch according to claim 1.

15. The motor vehicle of claim 14, wherein said opening mechanism is operatively connected to said outer handle.

16. A latch for a door of a motor vehicle, comprising:

a supporting body;

a closing assembly adapted to cooperate with a latch striker and which can assume a closing configuration in which the closing assembly engages the latch striker and keeps the closing assembly in a fixed position, and an opening configuration in which the closing assembly is disengaged from the latch striker;

an opening mechanism having an opening lever lying in a plane orthogonal to a first axis and rotatable about said first axis, said opening mechanism being selectively movable between a latched configuration in which said opening mechanism leaves said closing assembly in said closing configuration and an unlatched configuration in which said opening mechanism causes said closing assembly to move from said closing configuration into said opening configuration;

an inertia lever mounted to and housed within said supporting body and being free to rotate about a second axis between a release position in which said inertia lever is decoupled from said opening mechanism and a first blocking position and a second blocking position in which said inertia lever prevents said opening mechanism from moving said closing assembly from said closing configuration to said opening configuration;

wherein one of said opening lever and said inertia lever includes, in the plane, a main portion, a first tooth having a first abutting surface and a second tooth having a second abutting surface, said first tooth and said second tooth protruding from said main portion, and a slot interposed between said first tooth and said second tooth, wherein the other one of said opening lever and said inertia lever includes a main plate and a pin protruding from said main plate, wherein said slot is configured to receive said pin when said inertia lever is in said release position, and wherein said pin abuts said first abutting surface of said first tooth or said second abutting surface of said second tooth when said inertia lever is rotated to said first blocking position or rotated to said second blocking position; and wherein said inertia lever is rotatable to said first blocking position via inertial rotation due to its mass, in use, in a first direction from said release position to said first blocking position about said second axis to rotate said pin into abutment with said first tooth and prevent rotation of said opening lever about said first axis in response to an acceleration of said supporting body in a second direction opposite the first direction, and wherein said inertia lever is rotatable via inertial rotation due to its mass, in use, in a second direction, opposite to said first direction, from said release position to said second blocking position about said second axis to rotate said pin into abutment with said second tooth and prevent rotation of said opening lever about said first axis in response to an acceleration of said supporting body in the first direction, wherein said pin is arranged outside of said slot and is disengaged from said first abutting surface and said second abutting surface when said opening mechanism is in said latched configuration, in the absence of a vehicular collision.

17. A latch for a door of a motor vehicle, comprising:

a supporting body;

a closing assembly including a ratchet operable in a closing configuration for engaging and retaining a striker in a closed position and in an opening configuration to release the striker, said ratchet lying in a plane orthogonal to an axis and being rotatable about said axis;

an opening assembly operable in a latched configuration for maintaining said closing assembly in said closing assembly closing configuration and in an unlatched configuration for moving said closing assembly from said closing assembly closing configuration into said closing assembly opening configuration, said opening assembly including an opening lever lying in a plane orthogonal to a first axis and rotatable about said first axis between a latched position when said opening assembly is operating in said opening assembly latched configuration and an unlatched position for shifting said opening assembly into said opening assembly unlatched configuration, and a spring for normally biasing said opening lever toward said opening assembly latched position, said opening lever configured, in the plane, to include a first blocking surface, a second blocking surface, and a slot formed between said first blocking surface and said second blocking surface; and an inertia lever mounted to and housed in said supporting body and lying in a plane orthogonal to a second axis extending in parallel relation with the axis about which said ratchet rotates and being rotatable about said second axis in a first direction via inertial rotation due to its mass between a release position and a plurality of first blocking positions and in a second direction via inertial rotation due to its mass between said inertia lever release position and a plurality of second blocking positions and being normally biased toward said inertia lever release position, said inertia lever having a pin located to slide within said slot when said inertia lever is located in said inertia lever release position and said opening lever moves between the latched position and the unlatched position, wherein rotation of said inertia lever in said inertia lever first direction via inertial rotation in response to an acceleration of said supporting body in the second direction causes said pin to rotate into engagement with said first blocking surface and prevent movement of said opening lever from said opening lever latched position toward said opening lever unlatched position, and wherein rotation of said inertia lever in said inertia lever second direction via inertial rotation in response to an acceleration of said supporting body in the first direction causes said pin to rotate into engagement with said second blocking surface and prevent movement of said opening lever from said opening lever latched position toward said opening lever unlatched position.

18. The latch of claim 17 wherein said first blocking surface is formed on an edge of a first tooth portion of said opening lever and said second blocking surface is formed on an edge of a second tooth portion of said opening lever, wherein said slot is formed between said first tooth portion and said second tooth portion and is configured to permit movement of said opening lever between the latched position and the unlatched position when said inertia lever is located in said inertia lever release position, and wherein said pin is located outside of said slot when said opening lever is located in said opening lever latched position so as to permit pivotal movement of inertia lever about said second axis from said opening lever release position to either of the first blocking position and the second blocking position.

19. The latch of claim 17 wherein said opening assembly further includes a second opening lever rotatable about said first axis between a latched position and an unlatched position, and a second spring for normally biasing said second opening lever toward said second opening lever latched position, wherein said opening lever is operatively connected to said second opening lever such that movement of said opening lever from said opening lever latched position into said opening lever unlatched position causes corresponding movement of said second opening lever from said second opening lever latched position into said second opening lever unlatched position, and wherein said second opening lever is operable upon movement to said second opening lever unlatched position to engage said closing assembly for causing said closing assembly to move from said closing assembly closing configuration into said closing assembly opening configuration.

20. The latch of claim 19 wherein said opening lever is connectable to a door handle of the motor vehicle.

21. A latch for a door of a motor vehicle, comprising:

a supporting body;

a closing assembly operable in a closing configuration for engaging and retaining a striker in a closed position and in an opening configuration to release the striker;

an opening assembly operable in a latched configuration for maintaining said closing assembly in said closing assembly closing configuration and in an unlatched configuration for moving said closing assembly from said closing assembly closing configuration into said closing assembly opening configuration, said opening assembly including an opening lever lying in a plane orthogonal to a first axis and rotatable about said first axis between a latched position when said opening assembly is operating in said opening assembly latched configuration and an unlatched position for shifting said opening assembly into said opening assembly unlatched configuration, and a spring for normally biasing said opening lever toward said opening lever latched position; and an inertia lever mounted to and housed in said supporting body and lying in a plane orthogonal to a second axis and rotatable about said second axis in a first direction via inertial rotation due to its mass between a release position and a first blocking position and in a second direction opposite said first direction via inertial rotation due to its mass between said inertia lever release position and a second blocking position and being normally biased toward said inertia lever release position;

wherein one of said opening lever and said inertia lever is configured, in the plane, to include a first blocking surface, a second blocking surface and a slot formed between said first blocking surface and said second blocking surface, wherein the other one of said opening lever and said inertia lever includes a pin located to slide within said slot when said inertia lever is in said inertia lever release position and said opening lever moves between the latched position and the unlatched position;

wherein rotation of said inertia lever in said inertia lever first direction via inertial rotation in response to an acceleration of said supporting body in the second direction causes said pin to remain located outside of said slot and to rotate into engagement with said first blocking surface and prevent movement of said opening lever from said opening lever latched position toward said opening lever unlatched position, and wherein rotation of said inertia lever in said inertia lever second direction via inertial rotation in response to an acceleration of said supporting body in the first direction causes said pin to remain located outside of said slot and to rotate into engagement with said second blocking surface and prevent movement of said opening lever from said opening lever latched position toward said opening lever unlatched position.

22. The latch of claim 21 wherein said first blocking surface is formed on an edge of a first tooth portion of said opening lever and said second blocking surface is formed on an edge of a second tooth portion of said opening lever, wherein said slot is formed between said first tooth portion and said second tooth portion and is configured to permit movement of said opening lever between the latched position and the unlatched position when said inertia lever is located in said inertia lever release position, and wherein said pin is fixed to said inertia lever and is located outside of said slot when said opening lever is located in said opening lever latched position so as to permit pivotal movement of inertia lever about said second axis from said inertia lever release position to either of the first blocking position and the second blocking position.

23. The latch of claim 21 wherein said opening assembly further includes a second opening lever rotatable about said first axis between a latched position and an unlatched position, and a second spring for normally biasing said second opening lever toward said second opening latched position, wherein said opening lever is operatively connected to said second opening lever such that movement of said opening lever from said opening lever latched position into said opening lever unlatched position causes corresponding movement of said second opening lever from said second opening lever latched position into said second opening lever unlatched position, and wherein said second opening lever is operable upon movement to said second opening lever unlatched position to engage said closing assembly for causing said closing assembly to move from said closing assembly closing configuration into said closing assembly opening configuration.

* * * * *